US011029618B2

(12) United States Patent
Sakuta et al.

(10) Patent No.: US 11,029,618 B2
(45) Date of Patent: Jun. 8, 2021

(54) CARRIER, ELECTROPHOTOGRAPHIC DEVELOPER AND PRODUCTION METHOD OF CARRIER

(71) Applicant: POWDERTECH CO., LTD., Kashiwa (JP)

(72) Inventors: Aya Sakuta, Kashiwa (JP); Makoto Ishikawa, Kashiwa (JP); Hiroki Sawamoto, Kashiwa (JP); Tetsuya Uemura, Kashiwa (JP)

(73) Assignee: POWDERTECH CO., LTD., Kashiwa (JP)

( * ) Notice: Subject to any disclaimer, the term of this patent is extended or adjusted under 35 U.S.C. 154(b) by 0 days.

(21) Appl. No.: 16/059,405

(22) Filed: Aug. 9, 2018

(65) Prior Publication Data

US 2019/0049870 A1 Feb. 14, 2019

(30) Foreign Application Priority Data

Aug. 9, 2017 (JP) ..... JP2017-154565

(51) Int. Cl.
*G03G 9/113* (2006.01)

(52) U.S. Cl.
CPC ..... *G03G 9/1134* (2013.01); *G03G 9/1131* (2013.01); *G03G 9/1135* (2013.01); *G03G 9/1138* (2013.01)

(58) Field of Classification Search
CPC .. G03G 9/1075; G03G 9/1131; G03G 9/1134; G03G 9/1135; G03G 9/1138
See application file for complete search history.

(56) References Cited

U.S. PATENT DOCUMENTS

| | | | | |
|---|---|---|---|---|
| 4,272,601 | A * | 6/1981 | Tokura | G03G 9/1138 430/137.13 |
| 4,514,485 | A * | 4/1985 | Ushiyama | G03G 9/1132 430/111.35 |
| 2006/0121385 | A1 | 6/2006 | Uemara et al. | |
| 2009/0297274 | A1 | 12/2009 | Kojima et al. | |
| 2013/0108951 | A1* | 5/2013 | Kikushima | G03G 9/0821 430/108.7 |
| 2017/0261875 | A1* | 9/2017 | Takatsuna | G03G 9/1134 |

FOREIGN PATENT DOCUMENTS

| | | | |
|---|---|---|---|
| JP | 05188654 | A * | 7/1993 |
| JP | 2005-099489 | A | 4/2005 |
| JP | 2010-224054 | | 7/2010 |
| JP | 4646781 | B2 | 3/2011 |
| JP | 5405159 | B2 | 2/2014 |
| JP | 2017122884 | A | 7/2017 |

OTHER PUBLICATIONS

English language machine translation of JP 05-188654 (Year: 1993).*
Alger, M.S.M.; Polymer Dictionary. Essex: Elsevier, Ltd.; p. 326; "polyamideimide". (Year: 1989).*
Extended European Search Report for related EP App No. 18188133.5 dated Jan. 10, 2019, 6 pgs.
Caseri, W., Polyamidimide, Aug. 2008, [online] 2 pgs., URL: roempp.thieme.de/roempp4.0/do/data/RD-16-03051.
Plastics Processing Databook, 2nd Edition, Jan. 28, 2002, Kanno Taihei, Japan, 6 pgs.

* cited by examiner

*Primary Examiner* — Christopher D Rodee
(74) *Attorney, Agent, or Firm* — Procopio, Cory, Hargreaves & Savitch LLP

(57) ABSTRACT

There is provided a carrier including a magnetic core material having a surface coated with a surfactant-containing resin mixture of an elemental fluorine-containing resin and a polyimide resin. The carrier has an elution amount of an eluted material into water in an elution test ranging from 180 ppm to 3,500 ppm.

17 Claims, No Drawings

CARRIER, ELECTROPHOTOGRAPHIC DEVELOPER AND PRODUCTION METHOD OF CARRIER

CROSS-REFERENCE TO RELATED APPLICATION

This application claims priority from Japanese Patent Application No. 2017-154565, filed on Aug. 9, 2017, the entire subject matter of which is incorporated herein by reference.

TECHNICAL FIELD

The present invention relates to a carrier including a carrier core material having a surface coated with a resin, an electrophotographic developer using the carrier, and a production method of the carrier.

BACKGROUND ART

An electrophotographic developing method includes adhering a toner in a developer to an electrostatic latent image formed on a photoreceptor to develop an image. As the electrophotographic developing method, a magnetic brush method using a magnet roller is widely used. The developer employed in this method is classified into a two-component developer composed of a toner and a carrier, and a one-component developer using only a toner.

In the two-component developer, the carrier particle is mixed/stirred with the toner and has a function of charging and conveying the toner. Compared with the one-component developer, the two-component developer allows good control in designing a developer. Accordingly, the two-component developer is widely used, for example, in a full-color developing device requiring high image quality, or an apparatus of performing high-speed printing, where reliability for image preservation and durability are required.

A carrier and a toner are mixed/stirred in a developer tank. At this time, the toner is sometimes fused to the surface of a carrier particle due to exothermic heat or physical stress. This is called carrier spent. When the carrier spent phenomenon progresses with use of the developer, the charging characteristics of the carrier are deteriorated over time to cause degradation in image quality, such as fogging or toner scattering. Accordingly, the developer in the developer tank has to be entirely replaced after the elapse of a certain period of time.

In order to prevent the carrier spent and extend the developer longevity, it has been proposed, for example, to coat the surface of a magnetic core material with a fluororesin. The fluororesin has a low surface energy and when the surface of a magnetic core material is coated with a fluororesin, the carrier spent can be prevented. On the other hand, the fluororesin shows poor adhesiveness to other materials, which makes it difficult to form a resin coat layer composed of only a fluororesin on the surface of a magnetic core material. Accordingly, for example, Patent Document 1 (JP-A-2005-99489) has proposed a carrier in which the surface of a magnetic core material is coated with a resin mixture of a fluororesin and a polyamideimide resin or the like. The polyamideimide resin is used as a binder component for closely adhering the fluororesin to the surface of the magnetic core material.

In Patent Document 1, as the method for forming a resin coat layer composed of the resin mixture on the surface of a magnetic core material, a method of heating a fluororesin, a binder component such as polyamideimide resin, and a magnetic core material while mixing and stirring these together with a solvent, is employed. However, in such a method, the fluororesin and the binder component can hardly be uniformly mixed, and it is difficult for a resin coat layer composed of a resin mixture having uniformly mixed therein a fluororesin and a binder component to be formed in a uniform film thickness on the surface of a magnetic core material.

Patent Document 2 (JP-B-4,646,781) has proposed a method where a resin solution is prepared by dispersing a fluororesin selected from a tetrafluoroethylene-hexafluoropropylene copolymer and a tetrafluoroethylene-perfluoroalkyly vinyl ether copolymer together with silicon oxide in a polyamideimide resin solution resulting from dissolution of a polyamideimide resin composed of a copolymer of trimellitic anhydride and 4,4'-diaminodiphenylmethane in water and the surface of a magnetic core material is coated with the resin solution to obtain a carrier in which the surface of a magnetic core material is coated with a resin mixture containing a fluororesin and a polyamideimide resin. In addition, Patent Document 3 (JP-B-5,405,159) describes a method of preparing the resin solution by using a surfactant.

In these methods, a fluororesin is dispersed in a polyamideimide resin solution, so that the mixed state of a fluororesin and a binder component is improved, compared with the method described in Patent Document 1. However, since the viscosity of the polyamideimide resin solution is high, it is still difficult to uniformly mix the fluororesin and the binder component by using a surfactant, or the like. Furthermore, the wettability of the polyamideimide resin solution to the magnetic core material is low. This makes it difficult to coat the surface of the magnetic core material in a uniform film thickness with the resin solution and form a resin coal layer in a uniform film thickness on the surface of the magnetic core material. Accordingly, a carrier having more improved spent resistance and charging stability, and an electrophotographic developer using the carrier are demanded.

SUMMARY

Accordingly, an aspect of the present invention provides a carrier having improved spent resistance and charging stability compared with conventional carriers, an electrophotographic developer using the carrier, and a production method of the carrier.

According to an embodiment of the present invention, there is provided a carrier including a magnetic core material having a surface coated with a surfactant-containing resin mixture of an elemental fluorine-containing resin and a polyimide-resin, and having an elution amount of an eluted material into water in an elution test ranging from 180 ppm to 3,500 ppm.

In the above carrier, the elemental fluorine-containing resin may be one or more members selected from a tetrafluoroethylene-hexafluoropropylene copolymer and a tetrafluoroethylene-perfluoroalkyl vinyl ether copolymer.

In the above carrier, the surfactant may be a nonionic surfactant.

In the above carrier, the magnetic core material may include a ferrite particle.

In the above carrier, the contents of the elemental fluorine-containing resin and the polyimide resin in the resin mixture may range, in terms of mass ratio, from 9:1 to 2:8.

According to another embodiment of the present invention, there is provided an electrophotographic developer includes the above carrier.

According to a further embodiment of the present invention, there is provided a production method of a carrier including a magnetic core material having a surface coated with a resin. The production method includes preparing a resin layer-forming liquid by dispersing an elemental fluorine-containing resin and a polyimide resin together with a surfactant in a dispersion medium, and coating the surface of the magnetic core material with the resin layer-forming liquid to obtain a carrier including the magnetic core material having the surface coated with a surfactant-containing resin mixture of an elemental fluorine-containing resin and the polyimide resin.

In the above production method, assuming a total amount of the elemental fluorine-containing resin and the polyimide resin is 100 parts by mass relative to the resin layer-forming liquid, a surfactant may be added in an amount of 1.0 to 50 parts by mass.

Accordingly, a carrier having improved spent resistance and charging stability compared with conventional carriers, and a production method of the carrier can be provided.

DETAILED DESCRIPTION

There will be described a carrier, an electrophotographic developer and a production method of the carrier according to embodiments of the present invention.

1. Carrier

First, the embodiment of the carrier according to the present invention is described. The carrier according to the present invention is a carrier including a magnetic core material having a surface coated with a surfactant-containing resin mixture of an elemental fluorine-containing resin and a polyimide resin. The carrier has an elution amount of an eluted material into water in an elution test ranging from 180 ppm to 3,500 ppm.

(1) Magnetic Core Material

In an embodiment of the present invention, the magnetic core material is not particularly limited as long as it satisfies magnetism, or the like required, for example, for a carrier of an electrophotographic developer, and a magnetic core material composed of a mixture of a magnetic component such as ferrite and a non-magnetic component such as resin, or the like can also be used. However, in the present invention, as the magnetic core material, various ferrites may preferably be used, and a spherical ferrite may more preferably be used. The composition of the ferrite is not particularly limited, but the ferrite preferably has, for example, a composition represented by the following formula:

$$(MnO)_x(MgO)_y(Fe_2O_3)_z,$$

where x+y+z=100 mol %, x=from 35 to 45 mol %, y=from 5 to 15 mol %, and z=from 40 to 55 mol %, Here, in the above formula, part of (MnO) and/or (MgO) may be substituted by one or more kinds of oxides selected from SrO, $Li_2O$, CaO, TiO, CuO, ZnO, NiO, $Bi_2O_3$, and $ZrO_2$. At this time, it is more preferable to substitute part of (MnO) and/or (MgO) by SrO.

A ferrite having such a composition has high magnetization and good uniformity of magnetization. More specifically, magnetization varies less among particles, and a carrier excellent in the image quality and durability is obtained. Accordingly, in the present invention, a ferrite having a composition represented by the above formula may be preferably used.

In the above formula, in the case where part of (MnO) and/or (MgO) is substituted by one or more kinds of oxides selected from the oxides recited above, the substitution amount thereof is preferably 0.35 mol %, or more and is preferably 5.0 mol % or less. When the substitution amount is from 0.35 to 5.0 mol %, reduction in the variation of magnetization among particles is more facilitated. In addition, generation of residual magnetization and coercive force in the ferrite can be reduced, and agglomeration between particles can be suppressed. In view of obtaining the above-described effects, the substitution amount is more preferably 3.5 mol % or less.

Incidentally, in the present description, unless otherwise indicated, the ferrite means an aggregate of individual ferrite particles.

(2) Resin Mixture

In the carrier of the present invention, the surface of the magnetic core material is coated with a surfactant-containing resin mixture of an elemental fluorine-containing resin and a polyimide resin. Hereinafter, the layer of the resin mixture covering the surface of the magnetic core material is referred to as a resin coat layer.

i) Elemental Fluorine-Containing Resin

The elemental fluorine-containing resin indicates a resin containing fluorine in the molecular structure and among others, indicates a resin obtained by polymerizing a fluorine-containing olefin (primarily fluororesin). The surface of the magnetic core material is coated with a resin mixture containing an elemental fluorine-containing resin, so that even when the carrier collides against the toner during stirring, or the like with the toner, the toner can hardly adhere to the carrier surface and the carrier spent can be prevented.

The elemental fluorine-containing resin includes, for example, a fluororesin such as polytetrafluoroethylene (tetrafluoroethylene resin (PTFE)), polychlorotrifluoroethylene (trifluoroethylene resin (PCTFE, CTFE), polyvinylidene fluoride (PVDF), polyvinyl fluoride (PVF), tetrafluoroethylene perfluoroalkyl vinyl ether copolymer (perfluoroalkoxy fluororesin (PFA)), tetrafluoroethylene-hexafluoropropylene copolymer (FEP), ethylene-tetrafluoroethylene copolymer (ETFE) and ethylene-chlorotrifluoroethylene copolymer (ECTFE).

In the present invention, as the elemental fluorine-containing resin, it is particularly preferable to use one or more kinds of resins selected from a tetrafluoroethylene perfluoroalkyl vinyl ether copolymer (PFA) and a tetrafluoroethylene-hexafluoropropylene copolymer (FEP). The tetrafluoroethylene perfluoroalkyl vinyl ether copolymer (PFA) and tetrafluoroethylene-hexafluoropropylene copolymer (FEP) have chemical resistance, heat resistance and electric characteristics equivalent to those of polytetrafluoroethylene, and on the other hand, are excellent in the abrasion resistance and processability, compared with polytetrafluoroethylene. Accordingly, the properties required for the resin coat layer provided on the magnetic core material are satisfied and at the same time, the handleability is good.

The elemental fluorine-containing resin has a low friction coefficient and can prevent adhesion of the toner. On the other hand, the elemental fluorine-containing resin has poor adhesiveness and it is difficult to closely adhere the elemental fluorine-containing resin to the surface of the magnetic core material. Then, in the present invention, the below-described polyimide resin is used as a binder (adhesive component) for closely adhering the elemental fluorine-containing resin to the surface of the magnetic core material.

ii) Polyimide Resin

The polyimide resin is a thermosetting resin. The polyimide resin after heat curing exhibits good adhesion to an inorganic material such as ferrite. In addition, the polyimide resin after heat curing has high heat resistance. Accordingly, when the polyimide resin is used as a binder, the elemental fluorine-containing resin can be firmly and closely adhered to the surface of the magnetic core material.

In addition, compared with the polyamideimide resin which is conventionally used as a binder at the time of coating of the surface of a magnetic core material with an elemental fluorine-containing resin (fluororesin), the polyimide resin has low thermal contractility. Generally, in the production step of a carrier, after coating the surface of a magnetic core material with a resin, a heat treatment called baking or curing, or the like is sometimes performed. Accordingly, even when the surface of the magnetic core material is completely coated with a resin, the resin contracts during heat treatment to expose part of the surface of the magnetic core material. However, in the present invention, a polyimide resin is used as a binder and therefore, compared with the case of using a polyamideimide resin as a binder, the resin contracts less at the time of heat treatment, so that the surface of the magnetic core material can be prevented from being exposed. The resin coat rate on the surface of the magnetic core material is high, and exposure of the magnetic core material, which gives rise to the separation of resin, is lessened, so that a carrier having high durability compared with conventional carriers can be obtained.

In the present invention, the polyimide resin may be a resin having an imide bond in the main chain and is not particularly limited. For example, an aromatic polyimide resin, or the like can be used.

(3) Surfactant

The carrier according to the present invention contains a surfactant, and the elution amount of the eluted material into water in an elution test is from 180 ppm to 3,500 ppm. The eluted material as used herein indicates a component eluted from the carrier into water when an elution test is performed by the later-described method, and the elution amount of the eluted material is a value calculated by the later-described method. Out of components constituting the carrier, the component having solubility in water is only a surfactant. Accordingly, the component dated from the carrier into water at the time of performing the later-described elution test can be regarded as a surfactant, and the value calculated by the later-described method can be regarded substantially as the elution amount of the surfactant into water. One of the methods for producing the carrier according to the present invention is a method where at the time of forming a resin coat layer, the resin coat layer is formed using a resin coat layer-forming liquid prepared by dispersing an elemental fluorine-containing resin and a polyimide resin together with a surfactant in water. In the case of producing the carrier by using a solution containing a surfactant, the carrier contains the surfactant. The elution amount correlates to the content of the surfactant in the resin coat layer.

If the elution amount is less than 180 ppm, it is difficult to coat the surface of the carrier core material with a resin mixture having uniformly mixed therein an elemental fluorine-containing resin and a polyimide resin. Therefore, a carrier having good spent resistance and charging stability can hardly be obtained from the viewpoint of achieving a more uniform mixed state of an elemental fluorine-containing resin and a polyimide resin in the resin mixture, the elution amount is more preferably 190 ppm or more, still more preferably 200 ppm or more.

On the other hand, since the surfactant has a hydrophilic group, if the elution amount in the carrier is increased, the amount of water attached to the carrier surface readily fluctuates due to a change in the ambient humidity. More specifically, if the elution amount is increased to exceed 3,500 ppm, the charge amount stability against a change in the embodiment where the carrier is used may be disadvantageously decreased. Furthermore, if the elution amount is increased to exceed 3,500 ppm, spent may be likely to occur. Occurrence of spent is not preferred because the charge amount stability decreases. From these viewpoints, the elution amount in the carrier is preferably 3,350 ppm or less, more preferably 2,000 ppm or less, still more preferably 800 ppm or less.

The surfactant is roughly classified into an ionic surfactant and a nonionic surfactant. The ionic surfactant is further classified into an anionic surfactant, a cationic surfactant, and an amphoteric surfactant. The carrier according to the present invention may contain any surfactant out of these four kinds of surfactants. However, front the viewpoint of stably maintaining the charge amount of the carrier, a nonionic surfactant is preferably used in the ionic surfactant, the hydrophilic group is ionic, and therefore, the charge amount of the carrier fluctuates according to the content of the ionic surfactant. Accordingly, in the case of using an ionic surfactant, the content thereof may affect the electric characteristics of the carrier. On the other hand, in the case of a nonionic surfactant, the hydrophilic group is nonionic, and therefore, the influence of the content or the like of the surfactant on the electric characteristics of the carrier is small. Consequently, compared with the case of using an ionic surfactant, use of a nonionic surfactant makes it easy to property control the charge amount of the carrier.

As the nonionic surfactant, for example, an ether-type surfactant and an ester-type surfactant can be used. The ether-type surfactant includes polyoxyethylene alkyl ether, polyoxyethylene alkylphenyl ether, polyoxyethylene alkylallyl ether, polyoxyethylene polyoxypropylene glycol or the like. The ester-type surfactant includes polyoxyethylene fatty acid ester, sorbitan fatty acid ester, glycerin fatty acid ester, oxyethylene-oxypropylene block polymer, or the like.

Incidentally, the anionic surfactant includes a fatty acid salt such as sodium oleate and castor oil, an alkyl sulfate ester such as sodium laurylsulfate and ammonium laurylsulfate, an alkylbenzenesulfonate such as sodium dodecylbenzenesulfonate, an alkylnaphthalenesulfonate, an alkylphosphoric acid ester salt, a naphthalenesulfonic acid-formalin condensate, a polyoxyethylene alkyl sulfate ester salt, or the like. The cationic surfactant includes an alkylamine salt such as laurylamine acetate, a quaternary ammonium salt such as lauryltrimethylammonium chloride and stearyltrimethylammonium chloride, or the like. The amphoteric surfactant includes an aminocarboxylic acid salt, an alkylamino acid or the like.

(4) Resin Coat Layer

In the present invention, it may be sufficient if the surface of the magnetic core material is coated with a surfactant-containing resin mixture of an elemental fluorine-containing resin and a polyimide resin, and the mixed state of the elemental fluorine-containing resin and the polyimide resin is not particularly limited. However, for the following reason, the resin coat layer provided on the surface of the magnetic core material preferably has a configuration where a granular elemental fluorine-containing resin is closely adhered to the surface of the magnetic core material by an action of the polyimide resin that is a binder component. More specifically, uneven distribution of the elemental fluorine-containing resin can be prevented by employing the above configuration. Consequently, it becomes easy to obtain a resin coat layer in which the mixed state of the elemental fluorine-containing resin and the polyimide resin in the resin mixture and the film thickness are uniform, and this makes it possible to obtain a carrier having a sharp charge amount distribution and provide an electrophotographic developer with improved spent resistance, charging stability and replenishment fogging.

i) Volume Average Particle Diameter of Elemental Fluorine-Containing Resin

In the resin coat layer, the elemental fluorine-containing resin is preferably dispersed as particles having a volume average particle diameter of 0.05 to 0.80 μm, and the volume average particle diameter is more preferably from 0.10 to 0.40 μm.

ii) Content Ratio of Elemental Fluorine-Containing Resin and Polyimide Resin

The contents of the elemental fluorine-containing resin and the polyimide resin in the resin mixture are, in terms of mass ratio, preferably as follows:

Elemental fluorine-containing resin:polyimide resin=from 9:1 to 2:8.

Fluorine has a low surface energy and as the content of the elemental fluorine-containing resin in the resin mixture is larger, a carrier with improved spent resistance and charging stability can be obtained. From this viewpoint, the content of the elemental fluorine-containing resin in the resin mixture is preferably 2/10 or more, more preferably 3/10 or more, still more preferably 4/10 or more.

On the other hand, the elemental fluorine-containing resin itself exhibits low adhesion to the surface of the magnetic core material. Accordingly, if the content of the polyimide resin in the resin mixture is less than 1/10, the elemental fluorine-containing resin may be separated from the surface of the magnetic core material due to exothermic heat or physical (mechanical) stress received daring stirring, or the like with the toner. Accordingly, from the viewpoint of obtaining a carrier having high durability capable of maintaining the spent resistance and charging stability for a long period of time, the content of the polyimide resin in the resin mixture is preferably 1/10 or more.

However, from the viewpoint of intending to enhance the spent resistance and enhance the charging stability, it is not proper to specifically limit the lower limit value of the content of the polyimide resin and the upper limit value of the content of the elemental fluorine-containing resin in the resin mixture, and as long as the elemental fluorine-containing resin can be closely adhered to the surface of the magnetic core material, even if the content of the polyimide resin is less than 1/10 and the content of the elemental fluorine-containing resin is more than 9/10, these contents are encompassed by the present invention.

iii) Amount of Surfactant

In the carrier according to the present invention, assuming the total amount of the mixture of an elemental fluorine-containing resin and a polyimide resin constituting the resin coat layer is 100 parts by mass, the surfactant is preferably contained in an amount of 1.0 to 50 parts by mass. When the amount of the surfactant relative to the total amount of the mixture is in the above range, the elution amount of the eluted material substantially falls within the above-described range. Here, from viewpoint of achieving a more uniform mixed state of the elemental fluorine-containing resin and the polyimide resin in the resin coat layer, the amount of the surfactant is preferably 2.0 parts by mass or more assuming the total amount of the mixture of an elemental fluorine-containing resin and a polyimide resin constituting the resin coat layer is 100 parts by mass. In addition, from the viewpoint of more improving the charge amount stability against a change in the environment where the carrier is used, the amount of the surfactant is preferably 40 parts by mass or less assuming the total amount of the mixture of an elemental fluorine-containing resin and a polyimide resin constituting the resin coat layer is 100 parts by mass. Incidentally, the mixture of an elemental fluorine-containing resin and a polyimide resin does not include a surfactant.

iv) Amount of Resin Coat

The surface of the carrier core material is coated with the above-described resin mixture, and the amount of resin coat of the magnetic core material with the resin mixture (containing a surfactant) is preferably 0.01 to 10 mass %, more preferably from 0.3 to 7 mass %, still more preferably from 0.5 to 5 mass %, relative to the magnetic core material. If the amount of resin coat of the magnetic core material with the resin mixture is less than 0.01 mass %, the resin coat layer can hardly be formed in a uniform film thickness on the surface of the magnetic core material. If the amount of resin coat of the magnetic core material with the resin mixture exceeds 10 mass %, aggregation of carriers with each other is likely to occur, and the fluidity of the carrier decreases. Consequently carrier adhesion, or the like is readily generated, leading to a reduction in productivity, such as reduction in the yield. In addition, since the fluidity of the carrier is low, stability of the toner in an actual machine is reduced, and the toner cannot be sufficiently charged or the toner cannot be appropriately conveyed to an electrostatic latent image, giving rise to fluctuation of the development characteristics.

v) Charge Control Agent/Electrical Conductor

In a resin-coated carrier, generally, various additives for controlling the charging characteristics on the carrier surface, such as charge control agent and electrical conductor, may be incorporated into the resin coat layer.

For example, a silane coupling agent is known as the charge control agent. A carrier used together with a negative toner can contain an aminosilane coupling agent in the resin coat layer, and a carrier used together with a positive toner can contain a fluorine-based silane coupling agent in the resin coat layer. Furthermore, in the resin coat layer, an electroconductive fine particle, for example, an organic electrical conductor such as electroconductive carbon, and an inorganic electrical conductor such as titanium oxide or tin oxide, can be contained as the electrical conductor. The charge control agent/electrical conductor are an optional additive that can be added, if desired.

(5) Volume Average Particle Diameter

The carrier according to the present invention is preferably spherical, and the volume average particle diameter is preferably from 20 to 100 μm, more preferably from 30 to 70 μm. If the volume average particle diameter of the carrier is less than 20 μm, the carriers are readily aggregated, and carrier adhesion is likely to occur. The carrier adhesion causes a white spot and is not preferred. If the volume average particle diameter of the carrier exceeds 100 μm, the carrier becomes too large, making it difficult to develop an electrostatic latent image with high definition. That is, the image quality is roughened, and disadvantageously, it is difficult to obtain a desired resolution.

2. Production Method of Carrier

Next, the embodiment of the production method of a carrier according to the present invention is described. The production method of a carrier according to the present invention is a production method of a carrier for producing a carrier in which the surface of a magnetic core material is coated with a resin, including preparing a resin laser-forming liquid by dispersing an elemental fluorine-containing resin and a polyimide resin together with a surfactant in a dispersion medium, and coating the surface of the magnetic core material with the resin layer-forming liquid to obtain a carrier in which the surface of the magnetic core material is coated with a surfactant-containing resin mixture of an elemental fluorine-containing resin and a polyimide resin. The production method is described below sequentially step by step.

(1) Resin Layer-Forming Liquid Preparation Step

In the production method of a carrier according to the present invention, a resin layer-forming liquid is prepared by dispersing an elemental fluorine-containing resin and a polyimide resin together with a surfactant in a dispersion medium.

According to the present invention, an elemental fluorine-containing resin and a polyimide resin are dispersed together with a surfactant in a dispersion medium, and the surface of the magnetic core material can thereby be coated with a resin mixture having appropriately mixed therein the elemental fluorine-containing resin and the polyimide resin. Consequently, uneven distribution of the elemental fluorine-containing resin in the resin coat layer can be prevented, and a resin coat layer having a uniform film thickness can be obtained. As a result, according to the above method, an electrophotographic developer with a sharp charge amount distribution and improved spent resistance, charging stability and replenishment fogging can be provided.

As for the elemental fluorine-containing resin, each of the resins exemplified above can be used. It is preferable to use a powder of the elemental fluorine-containing powder and disperse the powder of the elemental fluorine-containing resin in a dispersion medium. The volume average particle diameter of the elemental fluorine-containing resin is preferably from 0.05 μm to 0.80 μm, more preferably from 0.10 μm to 0.40 μm.

In the present invention, specific molecular structure, molecular weight, or the like of the polyimide resin are not particularly limited. In general, as the polyimide resin, a soluble polyimide resin and an insoluble polyimide resin are present, and either one may be used. However, in the present invention, a polyimide resin insoluble in the dispersion medium is used. Here, from the viewpoint of appropriately dispersing the polyimide resin in the dispersion medium by use of a surfactant, the dispersion medium is preferably water, and the polyimide resin is preferably a liquid at normal temperature.

When a surfactant is mixed with water to afford a concentration not less than the critical micell concentration, the surfactant forms a micell with a hydrophobic group inside and a hydrophilic group outside. A polyimide resin is incorporated into the inside of the micell, and a colloid in which the polyimide resin is dispersed in water can thereby be obtained. Use of a polyimide resin that is a liquid at normal temperature facilitates preparation of such a colloid solution. Then, a resin layer-forming liquid in which a solid elemental fluorine-containing resin is dispersed in the colloid solution of the polyimide resin is prepared, and this makes it possible to appropriately maintain the dispersed state of the polyimide resin in the dispersion medium until the completion of the coating step while keeping the viscosity of the resin layer-forming liquid low. Consequently, a resin layer-forming liquid having uniformly mixed therein an elemental fluorine-containing resin and a polyimide resin can be obtained.

Here, at the time of preparation of the resin layer-forming liquid, the method for dispersing the elemental fluorine-containing resin and the polyimide resin in the dispersion medium is not particularly limited. For example, the resin layer-forming liquid can be prepared by adding each of a fluorine-containing resin and a polyimide resin together with a surfactant to a dispersion medium to afford a predetermined mass ratio, and then mixing and stirring the mixture. The resin layer-forming liquid can also be prepared by adding a polyimide resin together with a surfactant to a dispersion medium, then mixing and stirring the mixture to prepare a colloid solution of the polyimide resin, adding a predetermined amount of an elemental fluorine-containing resin to the colloid solution, and mixing and stirring the resulting mixture. When such a two-step preparation method is employed, it becomes easier to uniformly disperse a polyimide resin and an elemental fluorine-containing resin in a dispersion medium. Alternatively, the resin layer-forming liquid may be prepared by preparing a suspension in which an elemental fluorine-containing resin is previously dispersed in a dispersion medium, adding the suspension of the elemental fluorine-containing resin to a separately prepared colloid solution of a polyimide resin, and mixing and stirring the mixture.

At the time of preparation of the resin layer-forming liquid, assuming the total amount of the elemental fluorine-containing resin and the polyimide resin is 100 parts by mass, the surfactant is preferably added in an amount of 1.0 to 50 parts by mass. By preparing a resin layer-forming liquid containing the surfactant in the above range relative to the elemental fluorine-containing resin, the elemental fluorine-containing resin can be appropriately dispersed in the resin layer-forming liquid, and the above-described effects are obtained. In this case, the elution amount of the eluted material is roughly from 180 ppm to 3,500 ppm.

Meanwhile, the surfactant is as described above. It is preferable to use a nonionic surfactant. In addition, the preferable range of the numerical value regarding the content ratio of the polyimide resin and the elemental fluorine-containing resin in the resin layer-forming liquid is the same as the value in the resin coat layer, and description thereof is omitted here.

At the time of producing the above-described carrier according to the present invention, it may also be considered to use a resin solution obtained by preparing a polyamic acid solution (polyamic acid varnish) in which a polyamic acid as a precursor of a polyimide resin is dissolved in a solvent, and dispersing an elemental fluorine-containing resin in the polyamic acid solution by use of a surfactant. However, in this case, the viscosity of the polyamic acid solution is high, and this makes it difficult to appropriately disperse the elemental fluorine-containing resin in the polyamic acid solution even by use of a surfactant. Furthermore, since the viscosity of the resin solution is high, the surface of the carrier core material can hardly be coated in a uniform thickness with the resin solution. Therefore, a resin coat layer having uniformly mixed therein an elemental fluorine-containing resin and a polyimide resin can be less likely to be formed, and it is also difficult to make the film thickness uniform. Hence, for obtaining the carrier according to the present invention, a resin layer-forming liquid where an elemental fluorine-containing resin is dispersed in a colloid solution prepared by dispersing a polyimide resin in a dispersion medium by use of a surfactant is preferably prepared.

The solid content concentration in the resin layer-forming liquid is preferably adjusted to be from 10 to 40 mass %, in view of workability at the time of coating the surface of a magnetic core material with the resin layer-forming liquid, the solid content concentration can be appropriately adjusted.

(2) Coating Step

The coating step is described below. The method for coating the surface of a magnetic core material with the resin layer-forming liquid is not particularly limited. For example, a brush coating method, a spray drying method using a fluidized bed, a rotary drying method, and a dip-and-dry method using a universal stirrer may be employed.

After coating the surface of the magnetic core material with the resin layer-forming liquid, a heat treatment may be appropriately performed by an external heating system using a fixed electric furnace, a fluidized electric furnace, a rotary electric furnace, a burner furnace, or the like or by an internal heating system using a microwave. This heat treatment is generally called baking or curing. By applying the heat treatment, the polyimide resin can be cured, and the elemental fluorine-containing resin can be firmly and closely adhered to the surface of the magnetic core material by means of the polyimide resin.

(3) Magnetic Core Material

In the present invention, as described above, the magnetic core material is not particularly limited. One example of the production method of the magnetic core material is described below, but in the present invention, the production method of the magnetic core material is of course not limited to the following method.

First, appropriate amounts of ferrite raw materials are weighed to afford a predetermined composition and after adding water, pulverized and mixed in a ball mill or a vibration mill, or the like for 0.5 hours or more, preferably for 1 to 20 hours. At this time, in the case of substituting part of MnO and/or MgO by other oxide, the oxide is also blended in a predetermined amount. The thus-obtained slurry is dried, further pulverized, and calcined at a temperature of 700 to 1,200° C. In the case of intending to obtain a ferrite particle having a low apparent density, the calcination step may be omitted.

Next, the calcined product is pulverized to 15 μm or less, preferably 5 μm or less, more preferably 2 μm or less, in a ball mill, a vibration mill, or the like, and water and, if desired, a dispersant, a binder, or the like are added to prepare a slurry. After adjusting the viscosity, the slurry is granulated by a spray drier, or the like. The granulated product is sintered at a temperature of 1,000 to 1,500° C. for 1 to 24 hours in an atmosphere where the oxygen concentration is controlled to a predetermined concentration.

The sintered product obtained by the sintering is deagglomerated, if desired, and classified. At the time of deagglomeration, the sintered product can be deagglomerated in a ball mill or a vibration mill, or the like. As for the classification method, an existing air classification method, mesh filtration method, precipitation method, or the like may be employed. The particle size is preferably adjusted to a desired particle diameter by classification.

Thereafter, if desired, the electric resistance may be adjusted by applying an oxide film treatment to the surface of the sintered product. The oxide film treatment may be performed using a commonly used rotary electric furnace, batch electric furnace, or the like, for example, by applying a low-temperature heat treatment at 300° C. to 700° C. to the surface of the sintered product. After the oxide film treatment, the thickness of the oxide film formed on the surface of the ferrite particle is preferably from 0.1 nm to 5 μm. If the thickness of the oxide film is less than 0.1 nm, the effect gained by applying an oxide film treatment to the surface of the sintered product is reduced, and the electric resistance cannot be sufficiently adjusted. If the thickness of the oxide film exceeds 5 μm, the magnetization of the obtained ferrite particle is decreased or the resistance becomes too high, and a problem such as decrease in development capacity is likely to arise. If desired, a reduction treatment may be performed before the oxide film treatment. A magnetic core material composed of a ferrite particle can be obtained through these steps.

3. Electrophotographic Developer

The electrophotographic developer according to the present invention is described below. The electrophotographic developer according to the present invention is characterized by using the above-described carrier according to the present invention. In particular, the electrophotographic developer according to the present invention is preferably a two-component electrophotographic developer containing the carrier and a toner.

In the electrophotographic developer according to the present invention, the toner used together with the carrier is not particularly limited. For example, various toners produced by known methods such as suspension polymerization method, emulsion polymerization method and pulverization method may be used. For example, a toner produced by the method where a binder resin, a colorant, a charge control agent, or the like are sufficiently mixed using a mixer such as Henschel mixer and the mixture is uniformly dispersed by melt-kneading it in a twin-screw extruder, or the like cooled, finely pulverized in a jet mill, classified, and further classified by means of an air classifier, or the like to a desired particle size, can be used. At the time of production of this toner, a wax, a magnetic powder, a viscosity modifier, and other additives may be incorporated, if desired. Furthermore, external additives may also be added after the classification.

The binder resin for use in the production of the toner is not particularly limited. For example, resins such as polystyrene, chloropolystyrene, styrene-chlorostyrene copolymer, styrene-acrylic acid ester copolymer, styrene-methacrylic acid copolymer, rosin-modified maleic acid resin, epoxy resin, polyester, polyethylene, polypropylene, polyurethane and silicone resin, may be used individually or in combination, as needed.

The charge control agent for use in the production of the toner includes a nigrosine-based dye, a quaternary ammonium salt, an organometallic complex, a chelate complex, a metal-containing monoazo dye, or the like.

As the colorant for use in the production of the toner, conventionally known dyes and/or pigments can be used. For example, carbon black, phthalocyanine blue, permanent red, chromium yellow, phthalocyanine green, or the like may be used.

As other external additives, silica, titanium oxide, barium titanate, fluororesin fine particle, acrylic resin fine particle, or the like may be used individually or in combination. Furthermore, a surfactant, a polymerization agent, or the like may be appropriately added.

Incidentally, the electrophotographic developer according to the present invention is characterized by using the carrier according to the present invention, and other things are optional. More specifically, the above-described electrophotographic developer is merely one embodiment of the present invention, and the toner configuration, or the like may be appropriately changed without departing from the gist of the present invention.

The present invention is specifically described below by referring to Examples and Comparative Examples. However, the present invention is not limited to the following Examples.

Example 1

(1) Production of Magnetic Core Material

Firstly, raw materials were weighed to afford 39.7 mol % in terms of MnO, 9.9 mol % in terms of MgO, 49.6 mol % in terms of $Fe_2O_3$, and 0.8 mol % in terms of SrO. After weighing the raw materials, water was added thereto, and the resulting mixture was pulverized in a wet ball mill for 10 hours, mixed, dried, held at 950° C. for 4 hours, and then pulverized in a wet ball mill for 24 hours to prepare a slurry. This slurry was granulated, dried, held at 1,270° C. for 6 hours in an atmosphere with an oxygen concentration of 2%, deagglomerated, and then subjected to particle size adjustment to obtain a manganese-based ferrite particle. The manganese ferrite particle had a volume average particle diameter of 35 μm and a saturation magnetization of 70 $Am^2/kg$ at an applied magnetic field of 3,000 ($10^3/4\pi \cdot A/m$). The thus-produced manganese-based ferrite particle was used as the magnetic core material of Example 1.

(2) Resin Layer-Forming Liquid Preparation Step

A resin layer-forming liquid was prepared by dispersing elemental fluorine-containing resin particles in a colloid solution obtained by the dispersion of a liquid polyimide resin (PI) in water. On this occasion, a polyoxyethylene alkyl ether was used as a surfactant, and the surfactant was added such that assuming the total amount of the elemental fluorine-containing resin particle and the polyimide resin in the resin coat layer-forming liquid is 100 parts by mass, the amount of the surfactant is 4.4 parts by mass. In addition, in this Example, a tetrafluoroethylene-hexafluoropropylene copolymer resin particle (FEP) was used as the elemental fluorine-containing resin. At this time, the amount added of each resin relative to water was adjusted such that the contents of the elemental fluorine-containing resin particle and the polyimide resin in the resin layer-forming liquid are at a mass ratio of 8:2 in terms of solid content.

The concentration in terms of solid content of the elemental fluorine-containing resin and the polyimide resin in the resin layer-forming liquid was set to be 30 mass %. Here, the concentration in terms of solid content is a value expressing, in percentage (mass), the content of the mixed resin component of the polyimide resin and the elemental fluorine-containing resin relative to water that is a dispersion medium.

(3) Coating Step

Using the above manganese-based ferrite particle as the magnetic core material, the surface of the magnetic core material was coated with a resin coat layer. At this time, the above resin layer-forming liquid was used such that the amount of resin coat is 3.0 mass % relative to the magnetic core material. In addition, the magnetic core material and the resin layer-forming liquid were mixed using a fluidized bed coating apparatus to coat the surface of the magnetic core material with the resin layer-forming liquid. Thereafter, a heat treatment at 200° C. for 1 hour was applied to obtain Carrier 1.

Example 2

Carrier 2 was produced in the same manner as in Example 1 except that at the time of preparation of the resin layer-forming liquid, the surfactant was added such that assuming the total amount of the elemental fluorine-containing resin particle and the polyimide resin in the resin coat layer-forming liquid is 100 parts by mass, the amount of the surfactant is 2.3 parts by mass.

Example 3

Carrier 3 was produced in the same manner as in Example 1 except that at the time of preparation of the resin layer-forming liquid, the surfactant was added such that assuming the total amount of the elemental fluorine-containing resin particle and the polyimide resin in the resin coat layer-forming liquid is 100 parts by mass, the amount of the surfactant is 40 parts by mass.

Example 4

Carrier 4 was produced in the same manner as in Example 1 except that at the time of preparation of the resin layer-forming liquid, polyoxyethylene polyoxypropylene glycol was used as the surfactant.

Example 5

Carrier 5 was produced in the same manner as in Example 1 except that at the time of preparation of the resin layer-forming liquid, polyoxyethylene fatty acid ester was used, as the surfactant.

Example 6

Carrier 6 was produced in the same manner as in Example 1 except for adding the surfactant such that assuming the total amount of the elemental fluorine-containing resin particle and the polyimide resin in the resin coat layer-forming liquid is 100 parts by mass, the amount of the surfactant is 4.4 parts by mass, and at the same time, mixing the magnetic core material and the resin layer-forming liquid to have the amount of resin coat of 1.5 mass %.

Example 7

Carrier 7 was produced in the same manner as in Example 1 except for adding the surfactant such that assuming the total amount of the elemental fluorine-containing resin particle and the polyimide resin in the resin coat layer-forming liquid is 100 parts by mass, the amount of the surfactant is 4.4 parts by mass, and at the same time, mixing the magnetic core material and the resin layer-forming liquid to have the amount of resin coat of 5.0 mass %.

Example 8

Carrier 8 was produced in the same manner as in Example 1 except that at the time of preparation of the resin layer-forming liquid, an alkyl sulfate ester was used as the surfactant and the surfactant was added such that assuming the total amount of the elemental fluorine-containing resin particle and the polyimide resin in the resin coat layer-forming liquid is 100 parts by mass, the amount of the surfactant is 4.4 parts by mass.

Example 9

Carrier 9 was produced in the same manner as in Example 1 except that at the time of preparation of the resin layer-forming liquid, stearyltrimethylammonium chloride was used as the surfactant and the surfactant was added such that assuming the total amount of the elemental fluorine-containing resin particle and the polyimide resin in the resin coat layer-forming liquid is 100 parts by mass, the amount of the surfactant is 4.4 parts by mass.

COMPARATIVE EXAMPLES

Comparative Example 1

Carrier 10 was produced in the same manner as in Example 1 except that at the time of preparation of the resin layer-forming liquid, the surfactant was added such that assuming the total amount of the elemental fluorine-containing resin particle and the polyimide resin in the resin coat layer-forming liquid is 100 parts by mass, the amount of the surfactant is 80 parts by mass.

Comparative Example 2

Carrier 11 was produced in the same manner as in Example 1 except that at the time of preparation of the resin layer-forming liquid, the surfactant was not added.

Comparative Example 3

Carrier 12 was produced in the same manner as in Example 1 except that a polyamideimide resin (PAI) was used as the binder resin in place of the polyimide resin and at the time of preparation of the resin layer-forming liquid, the surfactant and the elemental fluorine-containing resin were added after dissolving the polyamideimide resin in water.

Evaluation

1. Evaluation Method

With respect to the carriers (Carriers 1 to 12) obtained in Examples 1 to 9 and Comparative Examples 1 to 3, the resin coat rate, the elution amount of the eluted material, the charge amount, and the fogging property were evaluated by the following methods. Incidentally, the method for measuring the volume average particle diameter of the magnetic core material and the method for measuring the saturation magnetization are described together below. In addition, the binder resin species, the elemental fluorine-containing resin species, the content ratio of binder resin and elemental fluorine-containing resin, the amount of resin coat, and the surfactant species, which were used in producing each carrier, are shown in Table 1.

(Volume Average Particle Diameter)

The average particle diameter (volume average particle diameter) of the manganese-based ferrite particle used as the magnetic core material was measured using Microtrac Particle Size Analyzer (Model 9320-X100) manufactured by Nikkiso Co., Ltd. Preparation of a sample was performed as follows. Water was used as the dispersion medium. After putting 10 g of the sample and 80 ml of water in a 100-ml beaker, two or three drops of a dispersant (sodium hexametaphosphate) were added, and the resulting mixture was dispersed for 20 seconds by using an ultrasonic homogenizer (Model UH-150, manufactured by SMT Co., Ltd.) and setting the output level to 4. Thereafter, bubbles formed on the surface of the beaker were removed, and the sample prepared in this way was measured by the Microtrac Particle Size Analyzer.

(Method for Calculating Resin Coat Rate)

A reflected electron image of each carrier was photographed using an electron microscope (Model JSM-6060A) manufactured by JEOL Ltd., at a magnification of 450 times and an applied voltage of 5 kV. This image was binarized using an image analysis software "Image Pro Plus" produced by Media Cybernetics, Inc. The binarization processing was performed for, out of particles included in the image, all particles of which entire profile can be confirmed, and the total number of particles targeted for the binarization processing was adjusted to be 100 or more by using a plurality of sheets of the image. Specifically, in the case of the carrier obtained in Examples and Comparative Examples, approximately from 20 to 25 particles of which entire profile can be confirmed are included in the image. Accordingly, the binarization processing was performed for approximately a total of 100 to 120 particles by using 4 or 5 sheets of the image. The image was separated into a black part (resin-coated part) and a white part (core material exposed part) by the binarization processing, and the area of each of the black part and the white part in each magnetic core particle material was measured. Then, the resin coat rate (%) was determined according to the following calculation formula. The results are shown in Table 2.

$$\text{Resin coat rate (\%)}=\{\text{area of black part}/(\text{area of black part}+\text{area of white part})\}\times 100$$

(Method for Measuring Elution Amount of Eluted Material)

With respect to each carrier, the elution amount of the eluted material into water was determined by the following method.

1) Preparation of Sample

Using each carrier as the specimen, a sample was prepared according to the following procedure.

a) The specimen was accurately weighed to within 200 g±0.002 g and put in a conical flask (hereinafter, referred to as "conical flask A").

b) 400 ml of ultrapure water (Direct-Q UV3 produced by Merck KGaA) was poured in conical flask A.

c) The mixture was stirred at 200 rpm for 10 minutes by using a rotary shaker (swivel type, Model RS-2) to obtain a mixed liquid of carrier and ultrapure water.

d) The mixed liquid was then left standing still for 24 hours in an environment at 25° C.

e) Subsequently, the mixed liquid in conical flask A was put in another conical flask (hereinafter referred to as "conical flask B") while holding the carrier by abutting a magnet against the bottom of conical flask A, to remove the carrier held by the magnet from the mixed liquid and the mixed liquid in conical flask B was filtered through an ultrafilter (pore size: 0.2 μm) to remove solid matters including a carrier not held by the magnet, a resin debris, or the like.

f) The filtrate filtered by the ultrafilter was dried in an environment at 50° C., and the resulting dried material was used as a sample for measuring the elution amount of the eluted material.

2) Quantitative Determination Method

The elution amount of the eluted material in each of the carriers of Examples and Comparative Examples was determined based on the following calculation formula:

$$\text{Elution amount (ppm) of eluted material}=\text{weight of sample}/\text{weight of carrier}\times 1000000$$

Here, the weight of carrier indicates the weight of each carrier used at the time of preparation of the mixed liquid, and the weight of sample indicates the weight of the dried material obtained after drying the filtrate.

Incidentally, by performing microscopic infrared spectrometry (μIR analysis) by use of "FT-IR (Model FTS3000MX)" and "microscope (Model UMA600)" manufactured by Digital Laboratory, Inc., it was confirmed that each eluted material is the predetermined surfactant species.

(Fogging)

First, an electrophotographic developer having a toner concentration of 5 mass % was prepared using each carrier and a commercially available toner (toner (T09C-01) produced by KYOCERA Document Solutions Inc., color:cyan).

Using the electrophotographic developer, image printing was performed in a color multifunction printer (KM-C2630) manufactured by KYOCERA Document Solutions Inc., and the fogging property was evaluated in the initial stage and after endurance printing of 100,000 times (after 100 K).

The fogging was measured using a color difference meter Z-300A manufactured by Nippon Denshoku Industries Co., LTD. Incidentally, the target fogging level is 5 or less. The results are shown in Table 2.

(Charge Amount)

Using the electrophotographic developer, the charge amount was determined by means of a suction-type charge amount measuring apparatus (Epping q/m-meter, manufactured by PES-Laboratoriumu).

In the measurement of the charge amount, the following conditions were employed as the predetermined environment condition.

Normal-temperature normal-humidity environment (NN environment): a temperature of 20 to 25° C. and a relative humidity of 50 to 60%.

High-temperature high-humidity environment (HH environment): a temperature of 30 to 35° C. and a relative humidity of 80 to 85%.

Here, the charge amount measured in the normal-temperature normal humidity environment is referred to as NN charge amount, and the charge amount measured in the high temperature high-humidity environment is referred to as HH charge amount.

The NN charge amounts in the initial stage and after 100 K were designated as "charge amount initial" and "charge amount 100 K", respectively. In addition, the difference between "charge amount initial" and "charge amount 100 K" was designated as "charge amountΔ". Furthermore the rate of environmental change of charge amount (HH/NN (%)) was determined based on the following calculation formula. Incidentally, the target rate of environmental change of charge amount is 100±20%.

Rate of environmental change of charge amount(HH/NN (%))=(HH charge amount/NN charge amount)×100

The results regarding the charge amount are shown in Table 2.

2. Evaluation Results

In all of Carriers 1 to 9 produced in Examples 1 to 9, the elution amount of the eluted material was from 180 to 3,500 ppm, the change in the charge amount after endurance printing was small, the rate of environmental change of charge amount was low, and the fogging property was good. Furthermore, in all cases, the resin coat rate was 50.0% or more, and compared with Carrier 11 in which a surfactant was not added at the time of preparation of the resin layer-forming liquid, a carrier having a high resin coat rate could be obtained.

Here, a nonionic surfactant is used in Carriers 1 to 7. An anionic surfactant and a cationic surfactant are used in Carrier 8 and Carrier 9, respectively. Compared with these, in Carriers 1 to 7 using a nonionic surfactant, a carrier having a high resin coat rate was obtained. In addition, compared with Carriers 8 and 9, in Carriers 1 to 7, the change in charge amount after endurance printing was on the same level, but the change in charge amount due to environmental change is small. These results reveal that from the viewpoint of providing a carrier having a higher resin coat rate and a small environmental change of charge amount, it is preferable for the carrier of the present invention to contain a nonionic surfactant.

On the other hand, in Carrier 10, the elution amount of the eluted material is large, the change in charge amount after endurance printing is large compared with Carriers 1 to 9, and the environmental change of charge amount is also large. In Carrier 11 in which the resin coat layer is formed without adding a surfactant, as described above, the resin coat rate is low, and the change in charge amount after endurance printing is large. Carrier 12 was produced by the same method as Carrier 1 of Example 1 except for using a polyamideimide resin as the binder resin. However, compared with Carrier 1, the resin coat rate of Carrier 12 was low. This is considered to be caused by the reason that the viscosity of the resin layer-forming liquid used for the production of Carrier 12 was large, making it difficult to uniformly apply the resin layer-forming liquid onto the surface of the magnetic core material, and since the polyamideimide resin has high thermal contractility compared with a polyimide resin, the polyamideimide resin was contracted in the heat treatment step after coating with the resin layer-forming liquid. As a result, compared with Carrier 1, the change in charge amount after endurance printing and the change in charge amount due to environmental change were increased in Carrier 12.

TABLE 1

| | | Binder resin Species | Elemental-Fluorine Containing Resin Species | Ratio of Elemental Fluorine-Containing Resin | Ratio of Binder Resin | Amount of Resin Coat (mass %) | Surfactant Species |
|---|---|---|---|---|---|---|---|
| Example 1 | Carrier 1 | PI | FEP | 8 | 2 | 3.0 | polyoxyethylene alkyl ether |
| Example 2 | Carrier 2 | PI | FEP | 8 | 2 | 3.0 | polyoxyethylene alkyl ether |
| Example 3 | Carrier 3 | PI | FEP | 8 | 2 | 3.0 | polyoxyethylene alkyl ether |
| Example 4 | Carrier 4 | PI | FEP | 8 | 2 | 3.0 | polyoxyethylene polyoxypropylene glycol |
| Example 5 | Carrier 5 | PI | FEP | 8 | 2 | 3.0 | polyoxyethylene fatty acid ester |

TABLE 1-continued

| | | Binder resin Species | Elemental-Fluorine Containing Resin Species | Ratio of Elemental Fluorine-Containing Resin | Ratio of Binder Resin | Amount of Resin Coat (mass %) | Surfactant Species |
|---|---|---|---|---|---|---|---|
| Example 6 | Carrier 6 | PI | FEP | 8 | 2 | 1.5 | polyoxyethylene alkyl ether |
| Example 7 | Carrier 7 | PI | FEP | 8 | 2 | 5.0 | polyoxyethylene alkyl ether |
| Example 8 | Carrier 8 | PI | FEP | 8 | 2 | 3.0 | alkyl sulfate ester |
| Example 9 | Carrier 9 | PI | FEP | 8 | 2 | 3.0 | stearyltrimethylammonium chloride |
| Comparative Example 1 | Carrier 10 | PI | FEP | 8 | 2 | 3.0 | polyoxyethylene alkyl ether |
| Comparative Example 2 | Carrier 11 | PI | FEP | 8 | 2 | 3.0 | — |
| Comparative Example 3 | Carrier 12 | PAI | FEP | 8 | 2 | 3.0 | polyoxyethylene alkyl ether |

TABLE 2

| | | Resin Coat Rate (%) | Elution Amount of Eluted Material (ppm) | Fogging Property Initial | Fogging Property After 100K | Charge Amount Initial | Charge Amount After 100K | Charge Amount Δ | Rate of Environmental Change of Charge Amount, HH/NN(%) |
|---|---|---|---|---|---|---|---|---|---|
| Example 1 | Carrier 1 | 85.1 | 366 | 0 | 1 | 45.3 | 40.5 | −4.8 | 87 |
| Example 2 | Carrier 2 | 70.3 | 193 | 1 | 3 | 44.1 | 38.2 | −5.9 | 90 |
| Example 3 | Carrier 3 | 90.1 | 3330 | 1 | 2 | 45.0 | 41.1 | −3.9 | 85 |
| Example 4 | Carrier 4 | 83.1 | 366 | 0 | 2 | 45.8 | 39.8 | −6.0 | 90 |
| Example 5 | Carrier 5 | 83.5 | 366 | 0 | 1 | 44.9 | 39.0 | −5.9 | 87 |
| Example 6 | Carrier 6 | 69.5 | 183 | 1 | 3 | 38.5 | 33.2 | −5.3 | 85 |
| Example 7 | Carrier 7 | 98.9 | 610 | 0 | 1 | 50.6 | 46.1 | −4.5 | 89 |
| Example 8 | Carrier 8 | 58.5 | 400 | 1 | 3 | 42.8 | 37.0 | −5.8 | 81 |
| Example 9 | Carrier 9 | 50.6 | 320 | 2 | 4 | 41.8 | 36.8 | −5.0 | 80 |
| Comparative Example 1 | Carrier 10 | 91.2 | 6659 | 3 | 6 | 46.0 | 35.7 | −10.3 | 70 |
| Comparative Example 2 | Carrier 11 | 46.5 | 0 | 7 | 10 | 43.2 | 30.1 | −13.1 | 90 |
| Comparative Example 3 | Carrier 12 | 50.7 | 380 | 6 | 8 | 43.1 | 30.1 | −13.0 | 72 |

INDUSTRIAL APPLICABILITY

According to the present invention, a carrier with improved spent resistance and charging stability compared with conventional carriers and a production method of the carrier can be provided.

The invention claimed is:

1. A carrier comprising:

(i) a magnetic core material having a surface; and (ii) a resin coat layer coating the core material surface, wherein the resin coat layer comprises a mixture of:

(a) an elemental fluorine-containing resin;

(b) a polyimide (PI) resin having an imide bond in the main chain; and (c) a surfactant;

wherein:

the surfactant has an elution amount of from 180 ppm to 3,500 ppm, remaining in water in an elution test comprising mixing the carrier into the water, filtering the carrier from the water, and measuring a weight of eluted material remaining after being removed from the water and dried, and a mass ratio of the polyimide (PI) resin to the elemental fluorine-containing resin in the resin coat layer of 1/10 or more.

2. The carrier according to claim 1, wherein the elemental fluorine-containing resin is a tetrafluoroethylene-hexafluoropropylene copolymer (FEP), a tetrafluoroethylene-perfluoroalkyl vinyl ether copolymer (PFA), or a combination thereof.

3. The carrier according to claim 1, wherein the surfactant is a nonionic surfactant.

4. The carrier according to claim 1, wherein the magnetic core material comprises an aggregate of individual ferrite particles.

5. A two component electrophotographic developer comprising a toner and the of claim 1.

6. A method for producing the carrier of claim 1, the method comprising:

preparing a resin layer-forming liquid including an elemental fluorine-containing resin and a polyimide resin dispersed together with a surfactant in a dispersion medium; and coating the surface of the magnetic core material with the resin layer-forming liquid to obtain the carrier.

7. The method according to claim 6, wherein assuming a total amount of the elemental fluorine-containing resin and the polyimide resin is 100 parts by mass relative to the resin layer-forming liquid, a surfactant is added in an amount of 1.0 to 50 parts by mass.

8. The carrier of claim 1, wherein the eluted material remaining in water in an elution test is in an amount ranging from 200 ppm to 800 ppm.

9. The carrier of claim 1, wherein the magnetic core material comprises a ferrite represented by formula:

$$(MnO)x(MgO)y(Fe_2O_3),$$

wherein:

x is from 35 to 45 mol %, and y is from 5 to 15 mol %, wherein part of (MnO) and/or (MgO) may be substituted by one or more oxides selected from SrO, $Li_2O$, CaO, TiO, CuO, ZnO, NiO, $Bi_2O_3$, or $ZrO_2$.

10. The carrier of claim 9, wherein the oxide substitution amount is from 0.35 to 5.0 mol %.

11. The carrier of claim 1, wherein the amount of resin coat of the magnetic core material is 0.01% to 10% by mass relative to the magnetic core material.

12. The carrier of claim 1, wherein the amount of surfactant in the resin coat layer is 2 to 40 parts by mass of 100 parts by mass of elemental fluorine-containing resin and PI resin.

13. The carrier of claim 1, wherein the polyimide resin having an imide bond in the main chain is not a polyamide-imide resin.

14. The carrier of claim 1, wherein the resin coat layer further comprises a charge control agent, an electrical conductor, or a combination thereof.

15. The carrier of claim 14, wherein the charge control agent is a silane.

16. The carrier of claim 15, wherein the silane is an aminosilane or a fluorine-based silane.

17. The carrier of claim 14, wherein the electrical conductor is electroconductive carbon, titanium oxide, or tin oxide.

* * * * *